US006204760B1

(12) United States Patent
Brunius

(10) Patent No.: US 6,204,760 B1
(45) Date of Patent: Mar. 20, 2001

(54) SECURITY SYSTEM FOR A BUILDING COMPLEX HAVING MULTIPLE UNITS

(75) Inventor: Robert Brunius, East Sound, WA (US)

(73) Assignee: Interactive Technologies, Inc., North St. Paul, MN (US)

( * ) Notice: Subject to any disclaimer, the term of this patent is extended or adjusted under 35 U.S.C. 154(b) by 0 days.

(21) Appl. No.: 09/238,750

(22) Filed: Jan. 28, 1999

Related U.S. Application Data

(60) Provisional application No. 60/073,176, filed on Jan. 30, 1998.

(51) Int. Cl.[7] ..... G08B 23/00

(52) U.S. Cl. ..... 340/529; 340/539; 340/506; 340/527; 340/531

(58) Field of Search ..... 340/529, 527, 340/528, 506, 531, 539

(56) References Cited

U.S. PATENT DOCUMENTS

| | | | | |
|---|---|---|---|---|
| 4,023,139 | | 5/1977 | Samburg | 340/541 |
| 4,114,147 | * | 9/1978 | Hile | 340/528 |
| 4,148,019 | | 4/1979 | Durkee | 340/531 |
| 4,228,424 | * | 10/1980 | Le Nay et al. | 340/506 |
| 4,375,637 | | 3/1983 | Desjardins | 340/517 |
| 4,408,251 | | 10/1983 | Kaplan | 361/172 |
| 4,465,904 | * | 8/1984 | Gottsegen et al. | 340/518 |
| 4,661,804 | | 4/1987 | Abel | 340/539 |
| 4,667,183 | * | 5/1987 | Gaudio | 340/528 |
| 4,721,954 | | 1/1988 | Mauch | 340/825.31 |
| 4,754,261 | | 6/1988 | Marino | 340/514 |
| 4,760,393 | | 7/1988 | Mauch | 340/825.31 |
| 4,855,713 | | 8/1989 | Brunius | 340/506 |
| 4,908,604 | * | 3/1990 | Jacob | 340/528 |
| 4,937,855 | | 6/1990 | McNab et al. | 379/103 |
| 4,951,029 | | 8/1990 | Severson | 340/506 |
| 5,499,014 | | 3/1996 | Greenwaldt | 340/539 |
| 5,598,456 | | 1/1997 | Feinberg | 379/42 |
| 5,625,338 | | 4/1997 | Pildner et al. | 340/539 |
| 5,737,391 | | 4/1998 | Dame et al. | 379/37 |
| 5,805,063 | | 9/1998 | Kackman | 340/539 |
| 5,809,013 | | 9/1998 | Kackman | 370/253 |

* cited by examiner

*Primary Examiner*—Donnie L. Crosland
(74) *Attorney, Agent, or Firm*—Fish & Richardson P.C., P.A.

(57) ABSTRACT

A security system and method for building complexes having multiple units provides enhanced resistance to intruder disablement, particularly for systems having a unit controller and user input device that are mounted within a common control panel. The system and method are useful with residential building complexes having residential units such as apartments and condominiums, and commercial building complexes having commercial units such as offices, businesses, or storage facilities. A unit controller communicates a unit alarm condition to a main controller located remotely from a respective unit. The unit alarm condition can be communicated via wireless communication. Also, the unit alarm condition is communicated without significant delay following the sensing of a security condition in the unit. For example, the unit controller can communicate the unit alarm condition to the main controller substantially immediately following sensing of the security condition. In this manner, the unit alarm signal is communicated to the main controller before an intruder is able to gain physical access to the control panel containing the unit controller. A user input device allows a user to enter information to invalidate the unit alarm condition communicated by the unit controller. If the unit alarm condition is not invalidated within a delay period, however, the main controller generates a main alarm condition and, sending notification to a security agency and activating a main alarm. The unit controller can be configured to activate an alarm within the unit in the event user input is not received within a second delay period. The system and method provide enhanced reliability and facilitate installation.

33 Claims, 2 Drawing Sheets

SECURITY SYSTEM FOR A BUILDING COMPLEX HAVING MULTIPLE UNITS

RELATED APPLICATION

This application claims priority of U.S. provisional application Ser. No. 60/073,176 filed Jan. 30, 1998.

TECHNICAL FIELD

The present invention relates to security systems including security systems useful in building complexes having multiple units.

BACKGROUND INFORMATION

In a typical security system, a main controller communicates with sensors positioned throughout a surveillance area, such as a home or business, to monitor various security conditions. For purposes of immunity from attack, the main controller forms a control panel that often is housed in a heavy, metal box. The control panel is typically placed in a remote location in the surveillance area such as in a basement or utility closet. The housing provides some degree of protection against an intruder trying to disable the internal circuitry for the main controller.

The sensors placed throughout the surveillance area may include door/window sensors, passive infrared sensors for motion, temperature sensors, and the like. Each sensor includes a transmitter. When a change in condition is sensed, the transmitter associated with a sensor transmits a sensor signal. The sensor signal includes information conveying the change in condition to the main controller. The sensor signal also can be transmitted to the main controller by hardwired communication. The various sensors are assigned zone numbers present in the main controller according to specific conditioning requirements.

The security system also includes a keypad or other user input device that is placed remotely from the control panel associated with the main controller. The keypad typically is placed or located near the entrance door for the house. This keypad may communicate with the main controller by hardwired or wireless communication. In some cases, the keypad may take the form of a portable, wireless unit that is carried by the resident, e.g., on a keychain.

When the resident opens a door that is monitored by a door/window sensor, the sensor transmits a sensor signal to the main controller indicating that the door has been opened. At that time, the main controller initiates a timer, giving the homeowner a delay period in which the security system can be disarmed using the keypad that is near the door. The delay period is usually referred to as the entry delay. If the security system is not disarmed within the entry delay, e.g., thirty seconds, the main controller enters an alarm state and generates an alarm signal. In response to the alarm condition, the security system may sound an alarm. Also, the main controller may be tied to a telephone system for the purpose of notifying a security agency or police of the alarm condition.

In the event an intruder enters the home and attempts to disable the security system, he is faced with two levels of difficulty. First, the main controller is located remotely from the main entrance and keypad. Indeed, the main controller often will be difficult to locate within the entry delay. Also, the intruder may misdirect his efforts toward the hardwired keypad next to the door, which will have no effect on the function of the remote control panel. Second, the housing containing the main controller will slow the intruder's efforts to access the internal electronics, particularly if the housing is formed from heavy metal. Thus, in a typical security system, it is generally difficult for an intruder to circumvent the system by disabling the main controller.

In security systems used for a building complex having multiple units, however, the task of disabling the main controller often is less daunting for an intruder. Unlike singlehome security systems, a multiple-unit system typically includes a local, unit security system for each unit. An apartment or condominium complex, for example, may provide a unit security system for each residential unit. An office building complex similarly may provide a unit security system for each office suite. Other commercial building complexes may include a unit security system for commercial units such as businesses or storage facilities.

The local security system includes a unit controller and a keypad or other user input device. Due to space and cost limitations, however, the unit controller and keypad typically are physically integrated with one another in a common control panel. For ready access to the keypad by the resident, the integrated control panel is installed near the main door to the unit. Each unit security system has one or more sensors to monitor, for example, the front door and any accessible windows. In some cases, motion sensors also may be provided. As in a single-home system, the sensors communicate with the unit controller by hardwired or wireless communication.

Instead of a link to a main controller, each unit controller has a direct telephone link to a remote security agency or police. In the event a unit controller indicates an alarm condition, it uses the telephone connection for notification. Connection of each unit controller to the telephone system is quite costly in terms of installation. For example, each unit controller must be equipped with an RJ3 IX line seizure device in order to take control of the telephone line for communication purposes. The line seizure device must be connected between the incoming telephone line and the first telephone in the unit that connects to the line. As a result, significant installation time is consumed by efforts to locate and obtain access to the proper telephone line location within the unit. Also, seizure of the telephone line by the security system can tie up the local telephone line for the unit, particularly in an emergency situation. As a further concern, reliance on a telephone line makes the system dependent on telephone service. Because telephone service is typically disconnected when the unit is vacant, unit vacancy renders the system inoperable and the unit particularly vulnerable to intrusion.

The physical integration and accessible location of the unit controller and keypad also makes multiple-unit security systems more susceptible to disablement by intruders. Specifically, intruders can disable the unit controller by essentially smashing the common control panel upon entry into the unit. When the intruder enters the unit through the main door, an associated sensor communicates a sensor signal to the unit controller. In response, the unit controller initiates a delay timer for the entry delay to allow a resident time to disable the security system. With its convenient location, however, an intruder has sufficient time to smash the control panel before expiration of the entry delay. As a result, the unit controller can be disabled before an alarm signal is sent via the telephone line. In other words, the unit security system can be rendered inoperable by an intruder before the alarm is activated.

SUMMARY

The present invention is directed to a security system and method for building complexes having multiple units. Such building complexes include residential building complexes having residential units such as apartments and condominiums, and commercial building complexes having commercial units such as offices, businesses, or storage facilities. Such a building complex also may include units in multiple buildings. The present invention provides enhanced resistance to intruder disablement, particularly for systems having a unit controller and user input device that are mounted within a common control panel.

In existing systems, it is possible for an intruder to disable the control panel before expiration of an applicable entry delay period, thereby preventing communication of a unit alarm condition, such as door entry, via the telephone line. In accordance with the present invention, however, the unit controller communicates the unit alarm condition to a main controller without significant delay following the sensing of a security condition in a respective unit. In particular, the unit controller preferably communicates the unit alarm condition to the main controller substantially immediately following sensing of the security condition. In this manner, the unit alarm signal is communicated to the main controller before the intruder is able to gain physical access to the control panel containing the unit controller.

The user input device allows a user to enter information or otherwise act to invalidate the unit alarm condition communicated by the unit controller. If the unit alarm condition is not invalidated within an entry delay period, however, the main controller generates a main alarm condition. Upon generation of the main alarm condition, the main controller can send notification to a security agency or police and activate a main alarm. Thus, efforts to disable the unit controller following entry into the unit are futile because the unit alarm signal has already been communicated to the main controller. The unit controller can be configured to activate an alarm within the unit in the event user input is not received within a second entry delay period maintained by the unit controller. In this manner, the unit controller, if operable, can operate to provide a unit alarm in conjunction with the notification or alarm activities initiated by the main controller.

In addition to improved reliability, the security system and method of the present invention offers significant installation advantages. For example, the unit controller preferably communicates with the main controller via wireless communication. Hard-wired communication is possible but less preferred. Also, the unit controller does not need to be connected to a telephone line. Instead, the main controller is connected to the telephone line and provides the link to a remote security agency or police. As a result, the unit controller does not require hardwired connections with the telephone line and, in particular, does require the cumbersome task of installing a line seizure device. Thus, the security system and method greatly facilitate installation of a system in each unit and significantly reduce the overall time and cost of installing security systems in multiple units.

As a further advantage, the security system and method of the present invention provide improved reliability for monitoring security conditions in vacant units. When a unit is vacant, telephone service ordinarily disconnected until the next occupancy. Thus, existing unit systems that rely on a telephone line connection are inoperable during vacancy. As a result, the vacant unit is vulnerable to intruder theft or vandalism or unauthorized occupancy, e.g., "squatting." With the system and method of the present invention, however, telephone service is not necessary for operation. Rather, the unit controller communicates with the main controller via wireless communication, and the main controller maintains continuous telephone service. As a result, the system and method are equally effective during periods of unit vacancy.

In a first embodiment, the present invention provides a security system for a building complex having multiple units, the system comprising a main controller, a sensor for sensing a security condition in one of the units and generating a sensor signal indicative of the security condition, a unit controller for communicating a unit alarm signal to the main controller without significant delay following generation of the sensor signal, and a user input device for receiving user input to invalidate the unit alarm signal, the unit controller communicating an alarm invalidation signal to the main controller in response to the user input, wherein the main controller generates a main alarm signal in the event the unit controller does not communicate the alarm invalidation signal within a delay period following communication of the unit alarm signal.

In a second embodiment, the present invention provides a method for monitoring security in a building complex having multiple units, the method comprising sensing a security condition in one of the units, communicating a unit alarm condition to a controller located remotely from the unit in which the security condition is sensed, the unit alarm condition being communicated without significant delay following sensing of the security condition, monitoring user input to invalidate the unit alarm condition, invalidating the unit alarm condition in response to the user input, and indicating a main alarm condition in the event the unit alarm condition is not invalidated within a delay period following communication of the unit alarm condition.

In a third embodiment, the present invention provides a security system for a building complex having multiple units, the system comprising a sensor, located in one of the units, for indicating a security condition in the unit, a main controller located remotely from the unit in which the sensor is located, a unit controller, located in the unit in which the sensor is located, for communicating a unit alarm condition to the main controller substantially immediately following indication of the security condition, a unit alarm associated with the unit in which the sensor is located, a user input device for receiving user input indicating invalidation of the unit alarm condition, wherein the unit controller and at least a portion of the user input device are mounted in a common housing, the unit controller invalidating the unit alarm condition in response to the user input and activating the unit alarm in the event the user input is not received by the user input device within a unit delay period following indication of the unit alarm condition, wherein the main controller indicates a main alarm condition in the event the unit alarm condition is not invalidated by the unit controller within a main delay period following communication of the unit alarm condition the main controller, the main controller activating a main alarm upon indication of the main alarm condition.

In a fourth embodiment, the present invention provides a security system for a building complex having multiple units, the system comprising a plurality of unit controllers, each of the unit controllers being associated with one of the units and monitoring security conditions within the respective unit, the unit controllers generating unit alarm signals in response to sensed security conditions, a main controller, positioned remotely from the unit controllers, for receiving the unit alarm signals from the unit controllers.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference numbers and designations in the various drawings indicate like elements.

DETAILED DESCRIPTION

Figure 1:
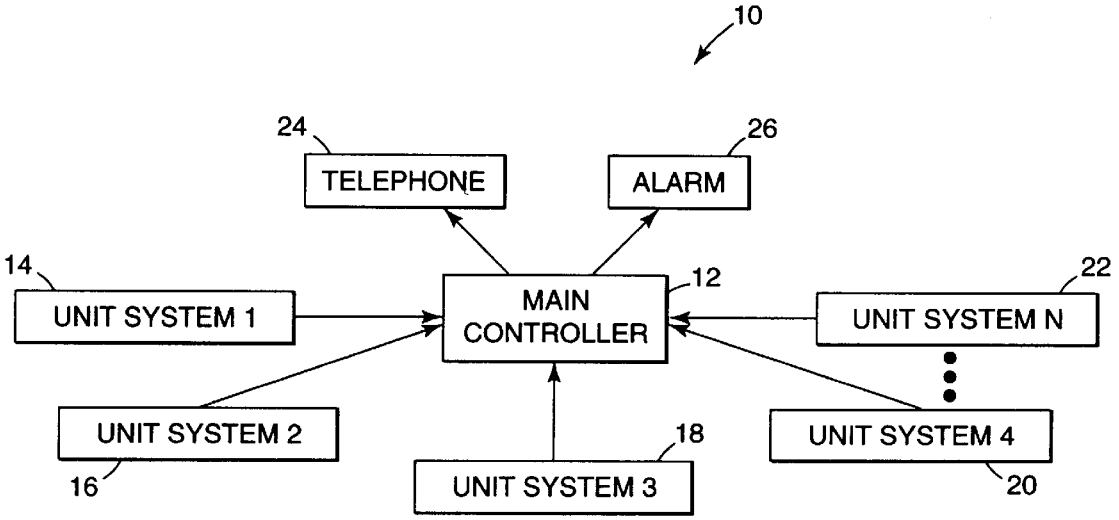
FIG. 1 is a functional block diagram of a security system for use in a building complex having multiple units.

FIG. 1 is a functional block diagram of a security system 10 for use in a building complex having multiple units. As shown in FIG. 1, security system 10 includes a main controller 12, unit systems 14, 16, 18, 20, 22, a telephone interface 24, and an alarm 26. Security system 10 is applicable to a variety of building complexes having multiple units including residential building complexes having residential units such as apartments or condominiums, and commercial building complexes having commercial units such as offices, businesses, or storage facilities. Unit systems 14, 16, 18, 20, 22 monitor various security conditions within respective units in the building complex. Main controller 12 operates in a supervisory capacity, communicating with each of unit systems 14, 16, 18, 20, 22, or some subset thereof, to monitor the security conditions among the units in the overall building complex.

Each unit system 14, 16, 18, 20, 22 is associated with one of the units in the building complex, and typically is located within a particular unit. Thus, for n units, security system 10 typically will include n unit systems. It is conceivable, however, that a single unit system 14, 16, 18, 20, 22 could be associated with two or more adjacent units. Main controller 12 typically will be located remotely from the units monitored by unit systems 14, 16, 18, 20, 22. For example, main controller 12 can be located in a central security or utility room within the complex, or at a site remote from the complex. Communication between main controller 12 and unit systems 14, 16, 18, 20, 22 can be wireless or hard-wired depending on the building complex. Wireless communication is preferred, however, for ease of installation as well as reliability of communication. In particular, unlike a hard-wired link, the wireless link cannot be physically severed by an intruder.

Unit systems 14, 16, 18, 20, 22 monitor security conditions such as intruder entry into the respective units, e.g., by door or window entry or motion detection. The monitored security conditions also may include the presence of fire, smoke, or irregular temperatures within the unit. Main controller 12 monitors the status of unit systems 14, 16, 18, 20, 22, for example, by listening for unit alarm signals transmitted from the unit systems. Alternatively, main controller 12 could be configured to periodically poll the individual unit systems 14, 16, 18, 20, 22 for unit alarm conditions. If one of unit systems 14, 16, 18, 20, 22 indicates a security condition, main controller 12 is operative to notify a security agency via interface 24 to the public telephone network. For example, main controller 12 may send notification to a municipal entity such as the police or fire department, or to a private security service. Also, main controller 12 may be configured to notify a resident of the security condition. Main controller 12 also can be equipped to activate a main alarm 26. Main alarm 26 may provide audible output, visible output, or a combination of both, and can be located with main controller 12 or at another location within the building complex.

Figure 2:
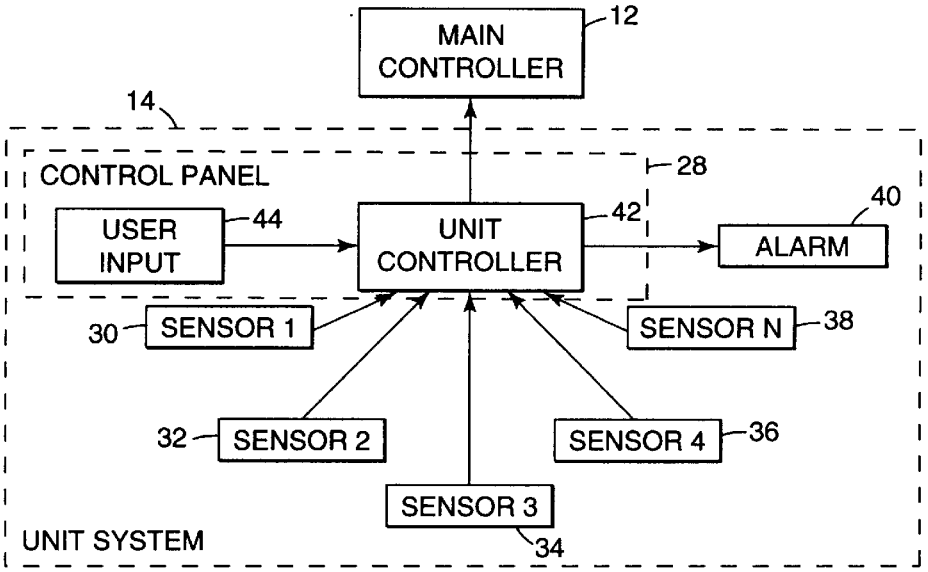
FIG. 2 is a functional block diagram of a unit security system for use with the security system of FIG. 1.

FIG. 2 is a functional block diagram of a unit system 14 for use with security system 10 as shown in FIG. 1. Unit system 14 includes a control panel 28, one or more (1–n) sensors 30, 32, 34, 36, 38, and a unit alarm 40. Control panel 28, sensors 30, 32, 34, 36, 38, and unit alarm 40 ordinarily will be located within a single unit. Control panel 28 includes a unit controller 42 and a user input device 44. Unit controller 42 and user input device 44 are mounted together in control panel 28, i.e., in a common housing, to conserve space and facilitate installation. As an alternative, unit controller 42 and user input device 44 conceivably could be housed separately but located adjacent one another. Control panel 28 can be mounted, for example, on a wall adjacent the main door of the respective unit. In this manner, control panel 28 is readily accessible by a resident upon entry into the unit. Each sensor 30, 32, 34, 36, 38 is located within a particular unit to monitor local security conditions within the unit. For example, sensors 30, 32, 34, 36, 38 may take the form of door/window entry sensors, motion sensors, fire, smoke, or temperature sensors, or a combination of such sensors.

Sensors 30, 32, 34, 36, 38 communicate with control panel 28 and, in particular, unit controller 42 by wireless or hardwired communication. Upon the detection of a security condition, a respective sensor 30, 32, 34 36, 38 communicates an indication of the security condition to unit controller 42, for example, by transmitting a sensor signal. The sensor signal typically will represent a change in the status of a monitored condition. For example, a sensor 30, 32, 34, 36, 38 configured to monitor a door will transmit a sensor signal to unit controller 42 when the door is opened. Upon receipt of a sensor signal from one of sensors 30, 32, 34, 36, 38, unit controller 42 indicates a unit alarm condition and communicates it to main controller 12, for example, by transmission of a unit alarm signal. The unit alarm signal can be communicated to main controller 12 by wireless or hardwired communication. Telephone communication between unit controller 42 and main controller 12 is possible but generally undesirable due to greater difficulty of installation and the possibility that the telephone line for the respective unit could be tied up during an emergency situation. Also, reliance on telephone service can make the unit vulnerable to intrusion during periods of unit vacancy. Hardwired communication links are susceptible to physical tampering, and also are less desirable. Accordingly, it is preferred that unit controller 42 communicate with main controller 12 by wireless radio frequency communication.

User input device 44 accepts user input to invalidate the unit alarm condition. In particular, unit controller 42 communicates with user input device 44 to receive indication of the user input for invalidation of the unit alarm condition. User input device 44 may take a variety of forms. For example, user input device 44 could be an alphanumeric keypad that allows entry of a code to indicate invalidation of the unit alarm condition. Alternatively, user input device 44 could be configured to accept a key that can be turned to indicate invalidation of the unit alarm condition. As a further alternative, user input device could take the form of a radio frequency receiver that receives an invalidating code from a transmitter carried by a unit resident, e.g., on a keychain. In any event, user input device 44 allows the system user to invalidate the unit alarm condition and disarm unit system 14.

User input device 44 is not capable of preventing unit controller 42 from communicating the unit alarm signal to main controller 12. Instead, unit controller 42 communicates the unit alarm signal to main controller 12 without significant delay following receipt of a sensor signal. In particular, unit controller 42 transmits the unit alarm signal to main controller 12 within a period of time during which an intruder is capable of obtaining physical access to control panel 28 following entry into the unit. Preferably, unit controller 42 communicates the unit alarm signal to main controller 12 substantially immediately following receipt of the sensor signal. In this manner, unit controller 42 is capable of circumventing efforts to disable unit system 14 by damaging control panel 28. In other words, the unit alarm condition is communicated before the intruder has the chance to disable control panel 28.

User input device 44 is incapable of preventing the transmission of the unit alarm signal. However, entry of user input into user input device 44 within an entry delay period allows a resident to invalidate the unit alarm signal. Specifically, upon generation of the unit alarm signal, unit controller 42 starts a timer that indicates the elapse of a unit delay period. The unit delay period should be sufficient to allow a typical user to enter the required information into user input device 44. If an indication of the required user input is received from user input device 44 prior to expiration of the unit delay period, unit controller 42 transmits a unit alarm invalidation signal to main controller 12.

Upon receipt of the original unit alarm signal, main controller 12 starts a separate timer that indicates the elapse of a main delay period. The unit and main delay periods can be of approximately the same length, but are timed separately by unit controller 42 and main controller 12, respectively. If the unit alarm invalidation signal is received from unit controller 42 prior to expiration of the main delay period, main controller 12 does not indicate a main alarm condition by generation of a main alarm signal. Consequently, main controller 12 does not notify a security agency of the security condition, nor activate an alarm, as illustrated in FIG. 1. Instead, main controller 12 invalidates the main alarm, resetting itself to wait for the next unit alarm signal from one of the unit systems 14, 16, 18, 20, 22 in the building complex. Similarly, upon generation of the unit alarm invalidation signal, unit controller 42 does not activate alarm 40, and instead resets itself to await a subsequent sensor signal from one of sensors 30, 32, 34, 36, 38.

If the user input is not received from user input device 44 prior to expiration of the unit delay period, unit controller 42 does not generate the unit alarm invalidation signal. Instead, under ordinary circumstances, unit controller 42 activates alarm 40, which may be positioned within the unit to provide audible output, visible output, or both. If control panel 28 is destroyed by an intruder, unit controller 42 may be rendered inoperable. In this case, unit controller 42 may be incapable of activating alarm 40, but also cannot generate the unit alarm invalidation signal. Thus, whether the unit period expires or control panel 28 is destroyed, unit alarm signal has already been sent to main controller 12. In either case, in the absence of a unit alarm invalidation signal, the main delay period timed by main controller 12 expires. With further reference to FIG. 1, upon expiration of the main delay period, main controller 12 proceeds on the basis of the unit alarm signal to notify a security agency via telephone interface 24 and activate alarm 26. Consequently, it is apparent that security system 10 is capable of operating successfully to detect an intruder or other security condition despite the possible efforts of an intruder to disable it by destroying control panel 28. At the same time, security system 10 allows a resident to enter user input for a period of time following transmission of the original unit alarm signal to disarm unit system 14.

Figure 3:
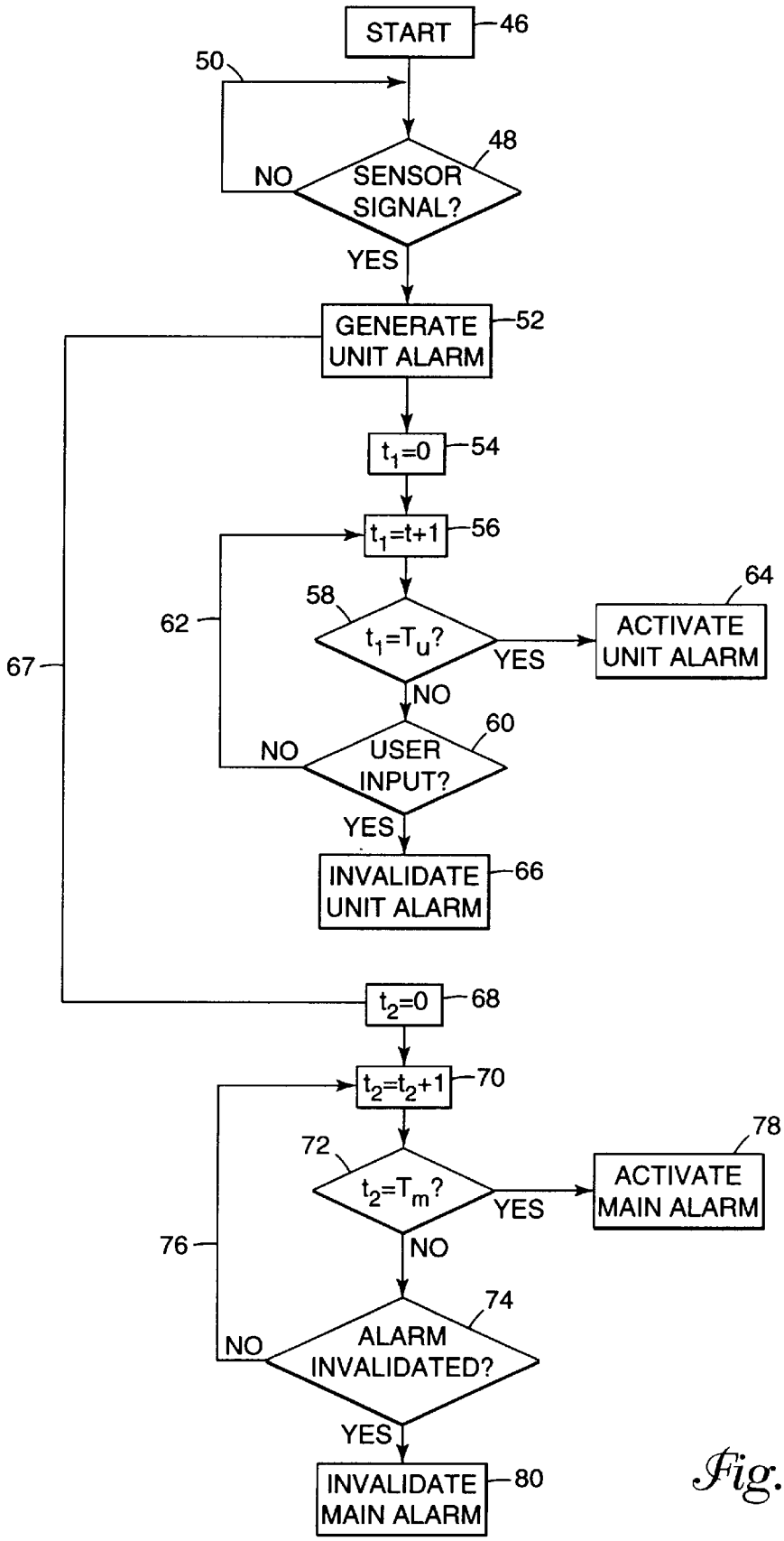
FIG. 3 is a flow diagram illustrating the operation of a unit security system as shown in FIG. 2.

FIG. 3 is a flow diagram illustrating the operation of a unit system 14 as shown in FIG. 2. Upon system initialization, or the start of operation, as represented by block 46, unit controller 42 begins to listen for sensor signals transmitted from sensors 30, 32, 34, 36, 38, as represented by block 48. Unit controller 42 continues to listen, as represented by loop 50, until a sensor signal is received. Upon receipt of a sensor signal, unit controller 42 immediately generates a unit alarm signal, as represented by block 52, and transmits the unit alarm signal to main controller 12. Unit controller 42 then starts a timer $t_1$, as represented by blocks 54 and 56. As the timer $t_1$ is incremented, unit controller 42 compares it to the unit delay period $T_u$, as represented by block 58. As long as the unit delay period $T_u$ has not expired, unit controller 42 continues to listen for user input from user input device 44, as represented by block 60 and loop 62. If appropriate user input has not been received prior to expiration of the unit delay period $T_u$, unit controller 42 activates unit alarm 40 within the unit, as represented by block 64. If user input is received in advance of expiration, however, unit controller 42 invalidates the unit alarm signal, as indicated by block 66. Unit controller 42 sends the unit alarm invalidation signal to main controller 12, which resets itself.

The operation of main controller 12 following receipt of a unit alarm signal will now be described with further reference to FIG. 3. Upon receipt of a unit alarm signal from unit controller 42, as represented by line 67, main controller 12 starts a timer $t_2$, as represented by blocks 68 and 70. As the timer $t_2$ is incremented, main controller 12 compares it to the main delay period $T_m$, as represented by block 72. As long as the unit delay period $T_m$ has not expired, main controller 12 continues to listen for the unit alarm invalidation from unit controller 42, as represented by block 74 and loop 76. If the unit alarm invalidation signal has not been received prior to expiration of the main delay period $T_m$, main controller 12 generates a main alarm signal, and proceeds to notify a security agency of the security condition by telephone interface 24 and activate main alarm 26, as indicated by block 78. If the unit alarm invalidation signal is received in advance of expiration of the main delay period $T_m$, however, main controller 12 invalidates the main alarm, as indicated by block 80. In particular, main controller 12 resets itself and listens for the next unit alarm signal to be transmitted by one of unit systems 14, 16, 18, 20, 22 within the building complex.

A number of embodiments of the present invention have been described. Nevertheless, it will be understood that various modifications may be made without departing from the spirit and scope of the invention. Accordingly, other embodiments are within the scope of the following claims.

What is claimed is:

1. A security system for a building complex having multiple units, the system comprising:

a main controller located remotely from the units;

a sensor for sensing a security condition in one of the units and generating a sensor signal indicative of the security condition;

a unit controller for communicating a unit alarm signal to the main controller without significant delay following generation of the sensor signal; and a user input device for receiving user input to invalidate the unit alarm signal, the unit controller communicating an alarm invalidation signal to the main controller in response to the user input, wherein the main controller generates a main alarm signal in the event the unit controller does not communicate the alarm invalidation signal within a delay period following communication of the unit alarm signal.

2. The security system of claim 1, wherein at least a portion of the user input device is located with the unit controller in a common housing.

3. The security system of claim 1, wherein the user input device and the unit controller are located in the unit in which the security condition is sensed by the sensor, and the main controller is positioned remotely from the unit in which the user input device and the unit controller are located.

4. The security system of claim 1, further comprising an alarm, wherein the main controller activates the alarm upon generation of the main alarm signal.

5. The security system of claim 1, wherein the main controller transmits a notification to a security agency upon generation of the main alarm signal.

6. The security system of claim 1, wherein the significant delay represents a period of time during which a typical intruder generally is capable of obtaining physical access to the unit controller following entry into the unit, the unit alarm signal being generated prior to expiration of the period of time.

7. The security system of claim 1, wherein the unit controller communicates the unit alarm signal to the main controller substantially immediately following generation of the sensor signal.

8. The security system of claim 1, further comprising an alarm associated with the unit in which the security condition is sensed by the sensor, wherein the unit controller activates the alarm in the event the user input is not received by the user input device within a second delay period following generation of the sensor signal.

9. The security system of claim 1, wherein the building complex is a residential building complex having residential units.

10. The security system of claim 1, wherein the building complex is a commercial building complex having commercial units.

11. The security system of claim 1, wherein the main controller is located within the building complex remotely from the units.

12. The security system of claim 1, wherein the main controller is located outside of the building complex.

13. A method for monitoring security in a building complex having multiple units, the method comprising:

sensing a security condition in one of the units;

communicating a unit alarm condition to a main controller located remotely from the unit in which the security condition is sensed, the unit alarm condition being communicated without significant delay following sensing of the security condition;

monitoring user input to invalidate the unit alarm condition;

invalidating the unit alarm condition in response to the user input; and generating at the main controller a main alarm condition in the event the unit alarm condition is not invalidated within a delay period following communication of the unit alarm condition.

14. The method of claim 13, further comprising activating an alarm upon indication of the main alarm condition.

15. The method of claim 13, further comprising transmitting a notification to a security agency upon indication of the main alarm condition.

16. The method of claim 13, wherein the step of indicating the unit alarm condition indicating the unit alarm condition via an electronic device located in the unit, and the significant delay represents a period of time during which an intruder is capable of obtaining physical access to the electronic device following entry into the unit, the unit alarm condition being indicated prior to expiration of the period of time.

17. The method of claim 13, wherein the step of communicating the unit alarm condition includes communicating the unit alarm condition to the main controller substantially immediately following sensing of the security condition.

18. The method of claim 13, further comprising the step of activating an alarm in the unit in the event the user input is not detected within a second delay period following generation of the sensor signal.

19. The method of claim 13, wherein the building complex is a residential building complex having residential units.

20. The method of claim 13, wherein the building complex is a commercial building complex having commercial units.

21. A security system for a building complex having multiple units, the system comprising:

a sensor, located in one of the units, for indicating a security condition in the unit;

a main controller located remotely from the unit in which the sensor is located;

a unit controller, located in the unit in which the sensor is located, for communicating a unit alarm condition to the main controller substantially immediately following indication of the security condition;

a unit alarm associated with the unit in which the sensor is located;

a user input device for receiving user input indicating invalidation of the unit alarm condition, wherein the unit controller and at least a portion of the user input device are mounted in a common housing, the unit controller invalidating the unit alarm condition in response to the user input and activating the unit alarm in the event the user input is not received by the user input device within a unit delay period following indication of the unit alarm condition, wherein the main controller indicates a main alarm condition in the event the unit alarm condition is not invalidated by the unit controller within a main delay period following communication of the unit alarm condition to the main controller, the main controller activating a main alarm upon indication of the main alarm condition.

22. The security system of claim 21, wherein the building complex is a residential building complex having residential units.

23. The security system of claim 21, wherein the building complex is a commercial building complex having commercial units.

24. A security system for a building complex having multiple units, the system comprising:

a plurality of unit controllers, each of the unit controllers being associated with one of the units and monitoring security conditions within the respective unit, the unit controllers generating unit alarm signals in response to sensed security conditions;

a main controller, positioned within the building complex remotely from the unit controllers, for receiving the unit alarm signals from the unit controllers; and a plurality of user input devices, each of the user input devices being associated with one of the unit controllers and receiving user input to invalidate one of the unit alarm signals generated by the respective unit controller, the respective unit controller communicating an alarm invalidation signal to the main controller in response to the user input.

25. The security system of claim 24, wherein the main controller receives the unit alarm signals from the unit controllers via wireless transmission.

26. The security system of claim 24, wherein the main controller generates a main alarm signal in the event the respective unit controller does not communicate the alarm invalidation signal within a delay period following communication of the unit alarm signal.

27. The security system of claim 24, wherein at least a portion of the user input device is located with the unit controller in a common housing.

28. The security system of claim 24, wherein each of the unit controllers communicates the unit alarm signal to the main controller without significant delay following the sensing of the security condition.

29. The security system of claim 28, wherein the unit controller communicates the unit alarm signal to the main controller substantially immediately following the sensing of the security condition.

30. The security system of claim 24, wherein the building complex is a residential building complex having residential units.

31. The security system of claim 24, wherein the building complex is a commercial building complex having commercial units.

32. The security system of claim 24, further comprising a telephone link, connected to the main controller, that connects the security system to a telephone system.

33. The security system of claim 32, wherein the telephone link connected to the main controller provides the sole connection between the security system and the telephone system.

* * * * *